US008523976B2

(12) United States Patent
Gries et al.

(10) Patent No.: US 8,523,976 B2
(45) Date of Patent: Sep. 3, 2013

(54) METAL POWDER

(75) Inventors: Benno Gries, Wolfenbüttel (DE); Leo Prakash, Rottenburg (DE)

(73) Assignee: H.C. Starck GmbH, Goslar (DE)

( * ) Notice: Subject to any disclaimer, the term of this patent is extended or adjusted under 35 U.S.C. 154(b) by 959 days.

(21) Appl. No.: 12/442,006

(22) PCT Filed: Sep. 21, 2007

(86) PCT No.: PCT/EP2007/060060

§ 371 (c)(1),
(2), (4) Date: Jun. 11, 2009

(87) PCT Pub. No.: WO2008/034903

PCT Pub. Date: Mar. 27, 2008

(65) Prior Publication Data

US 2009/0285712 A1 Nov. 19, 2009

(30) Foreign Application Priority Data

Sep. 22, 2006 (DE) ..... 10 2006 045 339

(51) Int. Cl.
*B22F 1/00* (2006.01)

(52) U.S. Cl.
USPC ..... 75/255; 75/252; 75/246; 419/10; 419/14; 419/33; 419/32; 419/38

(58) Field of Classification Search
USPC ..... 75/240, 252, 255, 236, 239, 242, 75/246; 419/14, 32, 38, 10, 13
See application file for complete search history.

(56) References Cited

U.S. PATENT DOCUMENTS 2,349,052 A * 5/1944 Ollier ..... 75/236
4,395,279 A * 7/1983 Houck ..... 75/255

(Continued)

FOREIGN PATENT DOCUMENTS

DE 29617040 U1 1/1997
EP 0865511 B1 8/1999

(Continued)

OTHER PUBLICATIONS

Mende, B., Hardmetal binders move on, Metal Powder Report, MPR Publishing Services, Shrewbury, GB, vol. 58, No. 3, 2003, pp. 28-29.

(Continued)

*Primary Examiner* — Roy King
*Assistant Examiner* — Christopher Kessler
(74) *Attorney, Agent, or Firm* — Novak Druce Connolly Bove + Quigg LLP

(57) ABSTRACT

The present invention relates to a metal powder mixture that is suitable for producing sintered bodies. The powder mixture is suitable as a binder for hard metals and contains: a) at least one prealloyed powder selected from the group of iron/nickel, iron/cobalt, iron/nickel/cobalt and nickel/cobalt; b) at least one element powder selected from the group of iron, nickel and cobalt or a prealloyed powder selected from the group consisting of iron/nickel, iron/cobalt, iron/nickel/cobalt and nickel/cobalt which is different from component a). The invention also relates to a cemented hard material which uses the inventive powder mixture and a hard material powder, wherein the overall composition of the components a) and b) together contains not more than 90% by weight of cobalt and not more than 70% by weight of nickel and the iron content.

21 Claims, 7 Drawing Sheets

(56) References Cited

U.S. PATENT DOCUMENTS

| | | | | |
|---|---|---|---|---|
| 6,170,917 | B1 * | 1/2001 | Heinrich et al. | 299/105 |
| 6,554,885 | B1 | 4/2003 | Mende et al. | |
| 6,613,122 | B1 | 9/2003 | Bonneau et al. | |
| 2005/0126336 | A1 * | 6/2005 | Jansson et al. | 75/240 |
| 2006/0169102 | A1 * | 8/2006 | Heinrich et al. | 75/238 |

FOREIGN PATENT DOCUMENTS

| | | | |
|---|---|---|---|
| EP | 1079950 | B1 | 8/2003 |
| EP | 0937781 | B1 | 9/2003 |
| EP | 1007751 | B1 | 7/2004 |
| EP | 1346074 | B1 | 6/2007 |
| WO | WO-99/10549 | A1 | 3/1999 |
| WO | WO-00/23631 | A1 | 4/2000 |
| WO | WO-00/50657 | A1 | 8/2000 |

OTHER PUBLICATIONS

Uhrenius B., et al. On the Composition of Fe-Ni-Co-WC-Based Cemented Carbides, International Journal of Refractory Metals & Hand Materials, vol. 15, 1997, pp. 139-149.

* cited by examiner

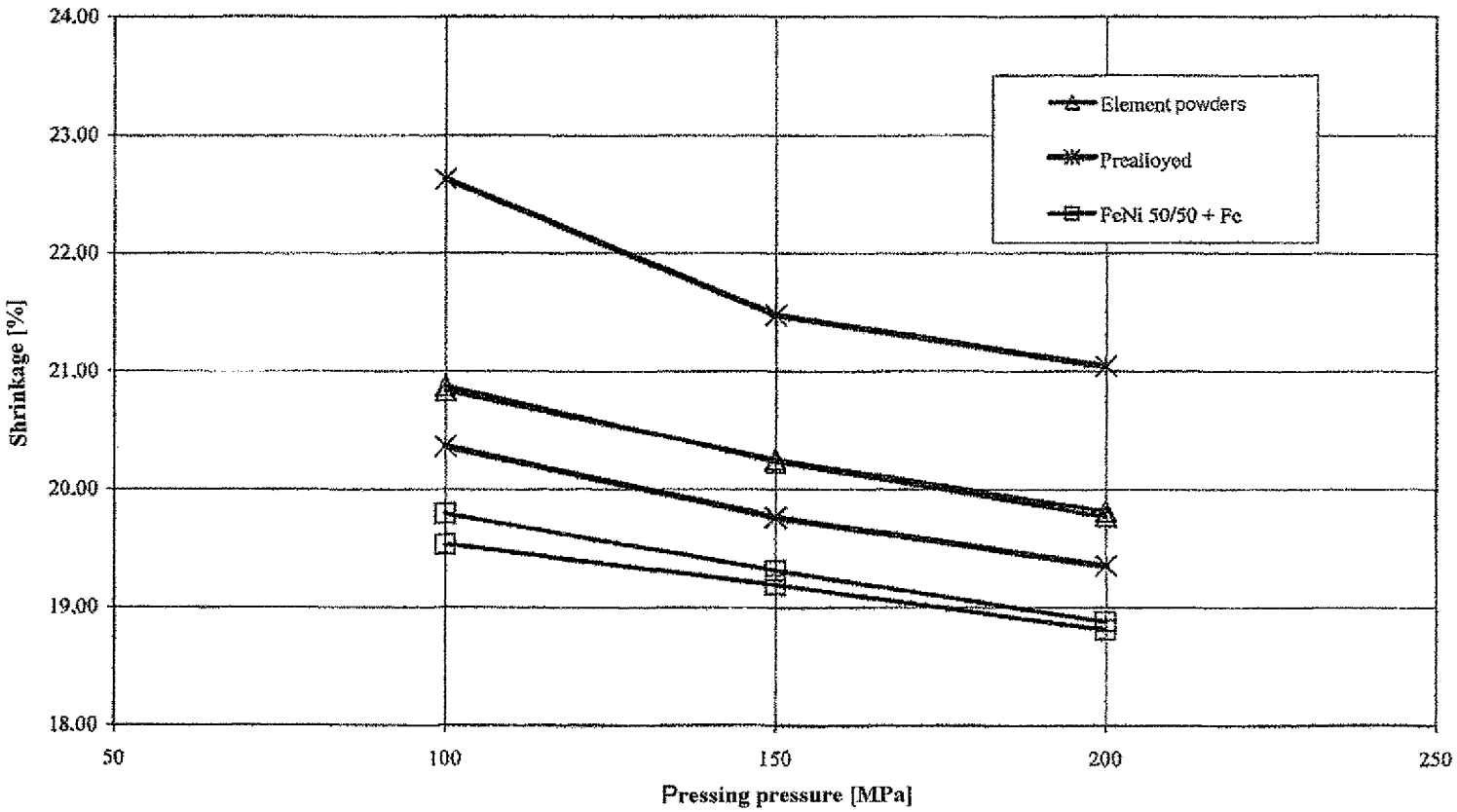
Figure 7: Shrinkage perpendicular and parallel to the pressing direction, WC DS 60 + 10% FeNi 85/15 without wax

METAL POWDER

CROSS-REFERENCE TO RELATED APPLICATIONS

This application is a national stage application (under 35 U.S.C. §371) of PCT/EP2007/060060, filed Sep. 21, 2007, which claims benefit of German application 10 2006 045339.5, filed Sep. 22, 2006.

BACKGROUND OF THE INVENTION

Cemented hard materials as sintered and composite material consist of at least two phases, namely a metallic binder phase and one or more hard material phases. Their various properties can be weighted by means of the respective proportion of the metallic and hard phases and the desired properties of the cemented hard material, e.g. strength, hardness, modulus of elasticity, etc., can be set in this way. The hard material phase usually consists of tungsten carbide but can, depending on the application of the cemented hard material tool, also comprise cubic carbides such as vanadium carbide, zirconium carbide, tantalum carbide or niobium carbide, their mixed carbides with one another or with tungsten carbide and also chromium carbide or molybdenum carbide. It is also possible to use nitrogen-containing cubic carbides ("carbonitrides"), for example in order to influence the phase ratios of the boundary zones during sintering. Typical binder contents in the case of cemented hard materials are in the range from 5 to 15% by weight, but in the case of specific applications they can also be lower at down to 3% and higher at up to 40% by weight.

In the case of classical cemented hard material, the metallic binder phase comprises predominantly cobalt. Due to the liquid-phase sintering and the dissolution and precipitation processes of the carbidic phase occurring during this, the metallic phase after sintering contains proportions of dissolved tungsten and carbon, often also Cr if, for example, chromium carbide is used as additive, and in the case of corrosion-resistant cemented hard materials also molybdenum. Very rarely, rhenium or ruthenium are also used as additive. The proportions of such metals which form cubic carbides are considerably lower in the binder because of the very low solubility.

In the sintered state, the metallic binder phase surrounds the hard material phase, forms a contiguous network and is therefore also referred to as "metallic binder" or as "binder". It is of critical importance to the strength of the cemented hard material.

For the production of cemented hard material, cobalt metal powder is usually mixed and milled together with hard material powders in liquids such as water, alcohols or acetone in ball mills or attritors. Here, deforming stressing of the cobalt metal powder takes place. The liquid suspension obtained in this way is dried, the granular material or powder produced ("cemented hard material mixture") is pressed to form pressed bodies and subsequently sintered with at least partial melting of the metallic binder, then, if appropriate, machined by grinding to final dimensions and/or provided with coatings.

Grinding operations require some engineering outlay since fine dusts which are harmful to health are produced or grinding sludges are produced and these represent a loss and their environmentally responsible handling incurs costs. It is therefore desirable to control the change in size of the pressed body during sintering in such a way that grinding operations become as superfluous as possible.

In powder metallurgy and in ceramics, the change in size of the pressed body during sintering is referred to as shrinkage. The linear shrinkage ($S_1$) of a dimension is calculated from the change in the dimension caused by sintering divided by the original dimension of the pressed body. Typical values for this linear shrinkage in the cemented hard material industry range from 15 to 23%. This value is dependent on numerous parameters such as organic auxiliaries added (e.g. paraffin, low molecular weight polyethylenes or esters or amides of long-chain fatty acids as pressing aids, a film-forming agent for stabilizing granules after spray drying, e.g. polyethylene glycol or polyvinyl alcohol, or antioxidants such as hydroxylamine or ascorbic acid). These organic auxiliaries are also referred to as organic additives. Further parameters which influence the shrinkage and its isotropy are, for example, the particle size and size distribution of the hard material powders, the mixing and milling conditions and the geometry of the pressed body. The more fundamental reason is that these parameters and additives influence the compaction process during pressing of the cemented hard material mixture to form the pressed body. Furthermore, elemental carbon or refractory metal powder are used as further additives (inorganic additives) to control the carbon content during sintering and these can likewise influence shrinkage and its isotropy.

In the case of axially pressed bodies, which are standard in industry, anisotropies in the pressed density occur due to internal friction and friction at the walls during compaction and these anisotropies cannot be eliminated even by varying the parameters of the previous batch. These density anisotropies lead to different shrinkages in two or even three dimensions in space (anisotropic shrinkage) and thus to stresses or even to cracks in the sintered piece and therefore have to be minimized as far as possible. It is generally experienced that the lower the shrinkage, the better the densifiability during pressing, the shrinkage can be controlled better in process engineering terms within the desired tolerances and the anisotropy of shrinkage can be reduced. Combined with appropriate design of the pressing materials, sintered parts which have or are close to final dimensions can then be produced. In the case of sintered parts having the desired final dimensions, grinding operations are then superfluous.

In the case of axial pressing, experience shows that there is a difference in the shrinkage perpendicular to and parallel to the pressing direction. However, in the case of simple geometries, e.g. cubes or plates having a square area perpendicular to the pressing direction, there are no significant differences in the two directions perpendicular to the pressing direction, so that it is sufficient to determine the shrinkage in only one of the two directions perpendicular to the pressing direction.

EP 0 937 781 B1 describes how the undesirable anisotropy of the shrinkage in the production of cobalt-bonded cemented hard materials made of tungsten carbide having a particle size of less than 1 μm by uniaxial pressing can be influenced by means of the particle size of the cobalt metal powder used as binder. It is desirable to obtain a shrinkage which is absolutely identical in the pressing direction and perpendicular thereto (=isotropic shrinkage), which corresponds to a value for the parameter K of one. The further the value of K is below one, the more anisotropic the shrinkage. The value of K should be at least 0.988 in order to avoid after-machining by grinding operations. For cemented hard materials containing 20% of cobalt, a K value of 0.960 is reported.

The K value can be calculated from the observed shrinkages S (in %) according to the following formula, where the indices "s" indicate perpendicular to the pressing direction, "p" indicate parallel to the pressing direction:

$$K = \frac{(Ss/100)+1}{(Sp/100)+1}$$

The global shrinkage $S_g$ in percent can be calculated from the pressed density and the sintered density according to the following formula:

$$Sg = 100\left(1 - \left(\frac{\text{pressed density}}{\text{sintered density}}\right)^{1/3}\right)$$

The global shrinkage does not take account of any differences in the 3 dimensions and is to be regarded as a mean of the shrinkages in the three directions in space. It makes prognosis of the shrinkage on the basis of the pressed density possible.

Owing to the health hazards associated with the dust of tungsten carbide/cobalt composites, as occurs, for example, in the grinding of sintered cemented hard material, and the often poor availability of cobalt as coproduct of nickel or copper production, there is considerable interest in replacing cobalt as binder phase.

Nickel-based binders have already been used as potential replacement for cobalt-based metallic binders, e.g. for corrosion-resistant or nonmagnetic types of cemented hard material. However, due to the low hardness and the high ductility at relatively high temperatures, such types of cemented hard material cannot be used for the cutting machining of metals.

Iron- and cobalt-containing metallic binder systems are therefore the center of interest and are already commercially available. Either element powders such as cobalt, nickel or iron metal powders or prealloyed powders are usually used as starting materials in the mix-milling with the hard material powders. The prealloyed powders represent the composition of the FeCoNi proportion of the binder which is desired after sintering even beforehand as prealloyed powder.

EP-B-1007751 discloses cemented hard materials containing up to 36% of Fe for cemented hard material applications. Here, performance advantages over cobalt-bonded cemented hard materials are achieved, since the sintered cemented hard material has a stable face-centered cubic (fcc) binder phase, in contrast to a cobalt-bonded cemented hard material which although it has an fcc binder phase after sintering changes into the hexagonal phase which is more stable at relatively low temperatures during use. This phase transformation results in a change in the microstructure, which is also referred to as work hardening, and a poor fatigue behavior, which cannot occur in the case of a stable fcc binder phase.

EPA-1346074 describes a cobalt-free type of binder based on FeNi for coated cutting tools made of cemented hard material. Here, no work hardening can occur due to the stability of the fcc binder phase which prevails over a wide temperature range from room temperature to the sintering temperature. As a result of the absence of cobalt, it can be assumed that the high-temperature properties (hot hardness) of the ductile binder are not satisfactory for particular applications, e.g. turning of metal.

It has long been known from DE-U-29617040 and the thesis of Leo Prakash (TH Karlsruhe, 1979) that cemented hard material comprising binder phases based on FeCoNi which display a phase transformation with martensite formation resulting from cooling after sintering display particularly high hot hardnesses and also a generally relatively high wear resistance and better chemical corrosion resistance. Although the region in which martensite can occur can be estimated from the phase diagram of the ternary system Fe—Co—Ni, the dissolved content of tungsten, carbon or chromium in the metallic binder after sintering results in a shift in the two-phase region in the sintered cemented hard material since these elements stabilize the fcc lattice type. A metallic binder phase comprising about 70% of iron, 10% of cobalt and 20% of nickel, which is composed of two phases as a result of a martensitic transformation during cooling, has been found to be particularly wear-resistant for some cemented hard material applications (B. Wittman, W.-D. Schubert, B. Lux, Euro PM 2002, Lausanne).

From a metallurgical point of view, it is advantageous to use the FeCoNi proportion of the metallic binder phase in prealloyed form as powder, since the use of element powders (e.g. Fe, Co and Ni powders) is known to result in locally different temperature and composition positions of the melt eutectics Co—W—C and Ni—W—C and Fe—W—C and thus in premature local shrinkage, inhomogeneities in the sintered microstructure and mechanical stresses. Chemical equilibria are therefore superimposed on the sintering process.

EP-A-1079950 describes processes for producing prealloyed metal powders comprising the alloy system FeCoNi. Here, coprecipitated metal compounds or mixed oxides are reduced by means of hydrogen at temperatures in the range from 300° C. to 600° C. to give the metal powder. As an alternative, prealloyed metal powders can also be produced by other processes in which it is possible for the metal components to be mixed by diffusion, for example mixing and heating of oxides. If the equilibrium phase composition of these powders predetermined by the overall composition consists of two phases at room temperature, these powders often contain proportions of a precipitated ferritic phase (body-centered cubic, bcc) as a result of cooling after production, and the fcc proportion (face-centered cubic, fcc) still present can be entirely or partly metastable. The alloy powders can thus be supersaturated at room temperature in respect of the bcc components to be precipitated, and the precipitation of bcc components can be promoted by mechanical activation of the powders even at room temperature. Due to the known poor deformability of bcc phases and their presence in finely divided form due to the precipitation, the bcc-containing cemented hard material powders obtained after mix-milling and drying are difficult to press. The result is low green densities, high and anisotropic shrinkages and a greater dependence of the pressed density on the pressing pressure, compared to element metal powders. Despite the pronounced homogeneity, prealloyed FeCoNi powders which tend to form two phases have therefore not been able to become established as starting material for the production of cemented hard material for process engineering reasons. Since the tungsten carbide is not deformed during pressing and only the metallic binder phase ensures the necessary ductility during pressing, the above-mentioned problems become increasingly apparent at a reduced binder content. Cemented hard materials having a martensitic binder state, which require a prealloyed binder powder having very high iron contents and thus high bcc contents, and low binder contents such as 6% can therefore be produced only with great difficulty in process engineering terms.

BRIEF SUMMARY OF THE INVENTION

It is an object of the present invention to provide a sintered cemented hard material having an FeCoNi-based metallic binder and improved pressing behavior before sintering and an acceptable shrinkage behavior using prealloyed FeCoNi alloy powder, and also a process for producing it and a metallic powder mixture suitable for this purpose.

This object is achieved by a process for producing a cemented hard material mixture using a) at least one prealloyed powder selected from the group consisting of iron/nickel, iron/cobalt, iron/nickel/cobalt and nickel/cobalt; b) at least one element powder selected from the group consisting of irons nickel and cobalt or a prealloyed powder selected from the group consisting of iron/nickel, iron/cobalt, iron/nickel/cobalt and nickel/cobalt which is different from component a); c) hard material powder, wherein the overall composition of the components a) and b) together contains not more than 90% by weight of cobalt and not more than 70% by weight of nickel. The iron content is advantageously at least 10% by weight.

A BRIEF DESCRIPTION OF THE FIGURES

FIG. 7 illustrates the results obtained for the dependence of the shrinkage on pressing pressure, on the alloying state of the binder metal powders and in directions perpendicular and parallel to the pressing direction.

DETAILED DESCRIPTION OF THE INVENTION

Figure 1:
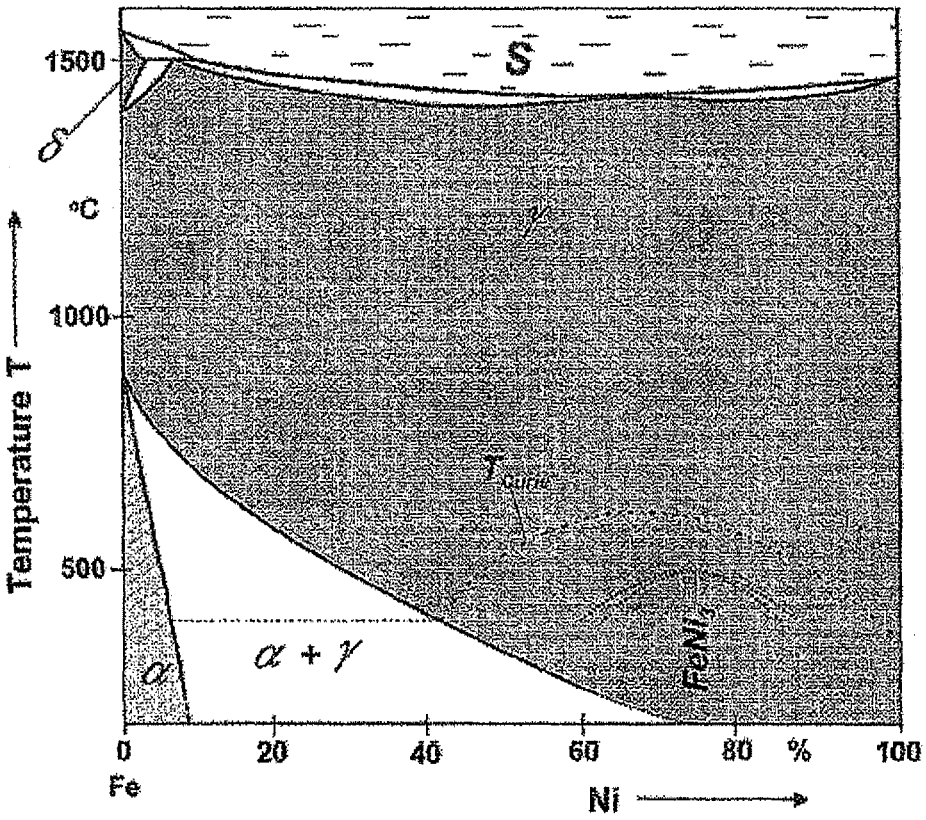
FIG. 1 illustrates the binary phase diagrams FeNi.

An advantageous embodiment of the invention is a process for producing a cemented hard material mixture as claimed in claim 1, wherein the overall composition of the binder comprises not more than 90% by weight of Co, not more than 70% by weight of Ni and at least 10% by weight of Fe, wherein the iron content satisfies the inequality $$\mathrm{Fe} \geq 100\% - \frac{\%\ \mathrm{Co} \cdot 90\%}{(\%\ \mathrm{Co} + \%\ \mathrm{Ni})} - \frac{\%\ \mathrm{Ni} \cdot 70\%}{(\%\ \mathrm{Co} + \%\ \mathrm{Ni})}$$

(where Fe: iron content in % by weight, % Co: cobalt content in % by weight, % Ni: nickel content in % by weight), and at least two binder powders a) and b) are used, one binder powder is lower in iron than the overall composition of the binder and the other binder powder is richer in iron than the overall composition of the binder and at least one binder powder is prealloyed from at least two elements selected from the group consisting of iron, nickel and cobalt.

It has surprisingly been found that it is not the actual proportion of the bcc phase of the metallic binder powder which is responsible for the poor densification behavior when using prealloyed powders, but instead the bcc proportion which is to be expected from theoretical considerations and is stable at room temperature, since phase transformations of prealloyed binder powders which are mechanically induced during mix-milling of these powders which have proportions of phases which are still metastable at room temperature (and lead to transformation hardening) are clearly responsible for the poor densification behavior. The stable fcc proportion which is to be expected at room temperature from theoretical considerations is therefore critical for favorable pressing and shrinkage behavior.

Component a) is advantageously a prealloyed metal powder and component b) is advantageously an element powder or a prealloyed powder having a different composition, with one of the components a) or b) particularly advantageously having a larger proportion of an fcc phase which is stable at room temperature than the overall composition of the binder if this were to be completely prealloyed. It is particularly advantageous for one of the components a) or b) to be lower in iron than the overall composition of the binder powder.

The other component in each case is accordingly richer in iron, with the contents of iron, nickel and cobalt adding up to the desired total composition of the binder (the composition of the components a) and b) together).

Since the densities and molar masses of the elements iron, cobalt and nickel are very similar, % by volume (% by volume), mole percent (mol %) and percent by weight (% by weight) are used synonymously in the present disclosure.

The nickel content of all the components together advantageously makes up 70% by weight or less of the powder mixture.

The nickel content of the components a) and b) together advantageously makes up 45% by weight or less of the powder mixture when the cobalt content is less than 5% by weight.

In a further embodiment of the invention, the nickel content of the two components a) and b) together makes up 45% by weight or less of the powder mixture when the cobalt content is less than 5% by weight.

In an advantageous embodiment of the invention, a) is a prealloyed powder comprising iron/nickel and b) is an iron powder. In a further embodiment of the invention, the component a) is a prealloyed powder such as FeNi 50/50, FeCo 50/50 or FeCoNi 40/20/40. The present invention also provided a cemented hard material mixture which can be obtained by the above-described process.

This cemented hard material mixture according to the invention can be used for producing shaped articles, preferably by pressing and sintering. The present invention therefore also provides shaped articles comprising a sintered metallic powder mixture according to the invention. The shaped article contains a hard material. In addition, the invention provides a cemented hard material obtainable by sintering a cemented hard material mixture according to the invention.

The present invention further provides a process for producing shaped articles, which comprises the steps:

- provision of a first prealloyed metal powder,
- provision of an element powder or a second prealloyed metal powder,
- mix-milling of the two components to give a cemented hard material mixture
- pressing and sintering of the cemented hard material mixture, giving a shaped article composed of a cemented hard material.

Figure 6:
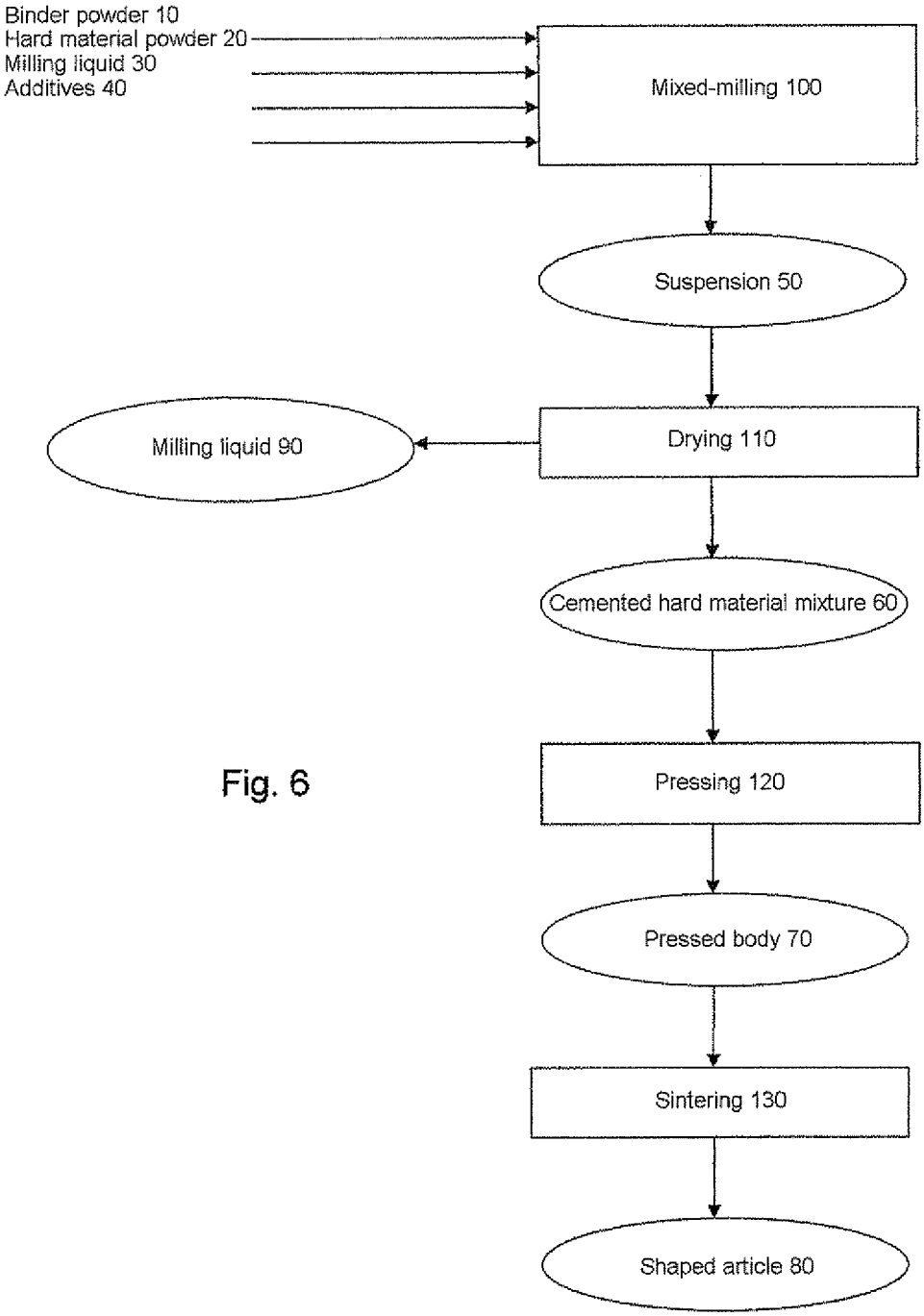
FIG. 6 illustrates schematically the process for producing shaped articles according to the invention.

The process for producing shaped articles is shown schematically in FIG. 6. The components a) and b), which are jointly referred to as binder powder 10, and the hard material powder 20 (component c) are subjected to mix-milling 100 using a customary milling liquid 30, e.g. water, hexane, ethanol, acetone and, if appropriate, further organic and/or inorganic additives (additives 40), for example in a bore mill or an attritor. The suspension 50 obtained is dried, with the milling liquid 90 being removed and a cemented hard material mixture 60 being obtained. This cemented hard material mixture is pressed into the desired shape by means of pressing 120 to give a pressed body 70. This is sintered by a customary process, as described in detail below (sintering 130). This gives a shaped article 90 composed of a cemented hard material.

In addition, customary auxiliaries can be present. These are, in particular, organic and inorganic additives.

Organic additives are, for example, paraffin, low molecular weight polyethylene or esters or amides of long-chain fatty acids, which are used as pressing aids; a film-forming agent to stabilize granules after spray drying, e.g. polyethylene glycol or polyvinyl alcohol, or antioxidants such as hydroxylamine or ascorbic acid. Low molecular weight organic compounds are particularly suitable as organic additives. If polymers are used, polymers having a low ceiling temperature of preferably below 250° C., for example polyacrylates and polymethacrylates such as polymethyl methacrylate, polyethyl methacrylate, polymethyl acrylate, polyethyl acrylate and also polyvinyl acetate or polyacetal homopolymers or copolymers, are suitable. These are generally used in amounts of from 1% by weight to 5% by weight, based on the total amount of the components a, b and c.

Inorganic additives are, for example, elemental carbon or refractory metal powder added to control the carbon balance during sintering; these can also influence the shrinkage and its isotropy. As refractory metal powder, it is possible to use, for example, tungsten, chromium or molybdenum metal powder. In general, these are used in weight ratios of less than 1:5, in particular less than 1:10, to the total binder content of the cemented hard material.

As carbon, it is possible to use carbon black or graphite. Suitable graphite powders generally have BET surface areas of from 10 to 30 $m^2/g$, in particular from 15 to 25 $m^2/g$, advantageously from 15 to 20 $m^2/g$. The particle size distributions have a d50 of usually from 2 to 10 μm, advantageously from 3 to 7 μm, and the d90 is generally in the range from 5 to 15 μm.

The essence of the invention is for a very small proportion of room-temperature-stable bcc phases of binder compositions which, were they to be completely prealloyed, would be in the bcc/fcc two-phase region at room temperature to be present during pressing. This is achieved by the overall composition of the binder to be set by means of at least two different powders of which one is room-temperature-stable bcc (for example iron powder or an iron-rich composition which is stable at room temperature and consists of one bcc phase) and another is room-temperature-stable fcc or has, at room temperature, a higher proportion of stable fcc than the overall composition would have if it were to be completely prealloyed.

A further characteristic of the invention is to have, during pressing, a very low proportion of bcc phase of such a binder composition compared to such a binder composition produced entirely from element powders. This is achieved by setting the overall composition by means of at least two different powders of which one has a higher proportion of fcc phase stable at room temperature compared to the use of element powders for producing the cemented hard material mixture.

The invention is thus preferably relevant for the FeCoNi composition range of the binder (overall composition) which in prealloyed form at room temperature (it is assumed that the temperature prevailing during mix-milling is in the range from room temperature to not more than 80° C.) is, according to the phase diagram, in the two-phase bcc (body-center cubic)/fcc (face-centered cubic) region, so that the prerequisite for mechanically activated precipitation of bcc phases is achieved. Since the fcc phases are more stable at high temperatures or their existence region is larger, it is a general rule that prealloyed metal powders in the FeCoNi system are, provided that the composition is in the two-phase region at room temperature, essentially supersaturated at room temperature in respect of the content of fcc phase due to the usual production temperatures in the range from 400 to 900° C. and therefore tend to precipitate bcc phase on mechanical activation. This preferred region is thus defined by the boundary of the fcc/bcc two-phase region to the fcc region. The overall composition of the binder is therefore preferably made up of one or more powders from the group consisting of prealloyed FeCoNi, FeNi, CoNi and Ni powders (with a higher proportion of room-temperature-stable fcc phase than the overall composition or even up to 100% of room-temperature-stable fcc, e.g. Ni powder or FeNi 15/85) and a powder from the group consisting of stable single-phase bcc powders and powders having a higher proportion of bcc phase stable at room temperature, e.g. iron powder, FeCo powder containing up to 90% of Co, FeNi 82/18 or FeCoNi 90/5/5.

In a prealloyed powder of the composition FeCoNi 40/20/40, face-centered cubic phase has surprisingly been found even at room temperature by means of X-ray diffraction, although published phase diagrams for this composition indicate that only the face-centered cubic phase is stable for this composition. Furthermore, the very high proportion of face-centered cubic phase after the mix-milling in example 1 is a further indication that the boundary line of the bcc/fcc two-phase region to the fcc phase has to run at far lower iron values than is indicated in the literature.

Figure 2:
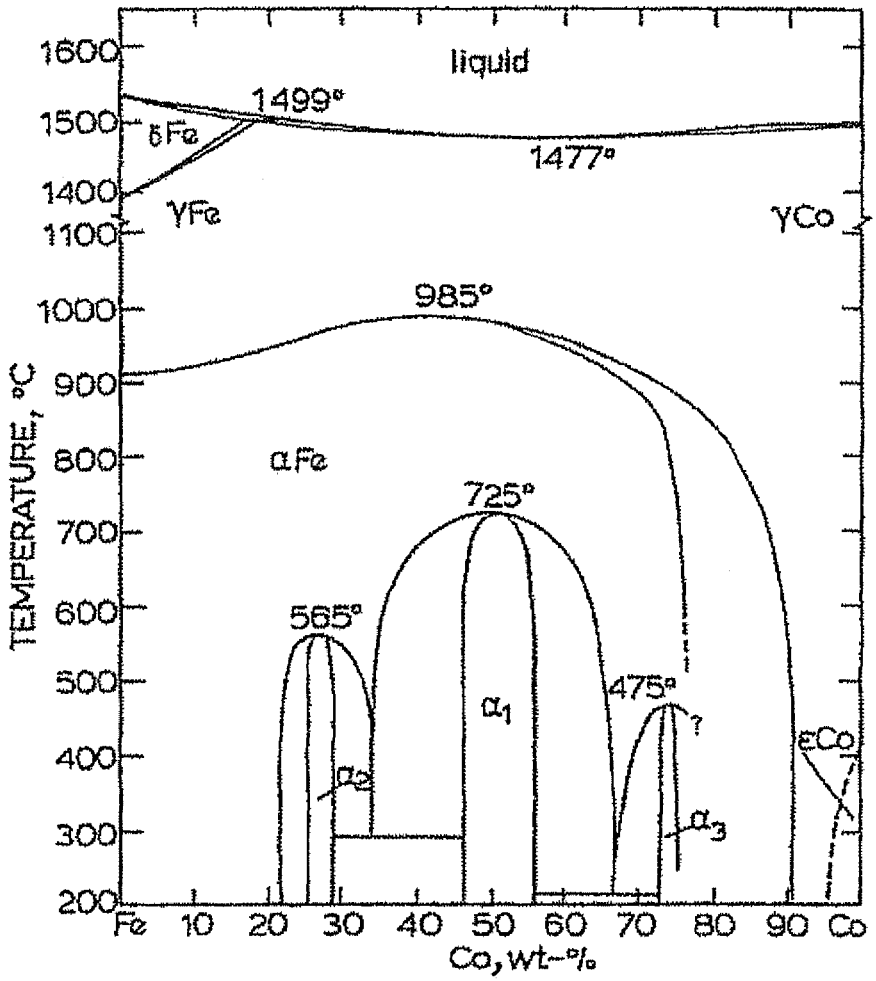
FIG. 2 illustrates the binary phase diagram of FeCo.
Figure 3:
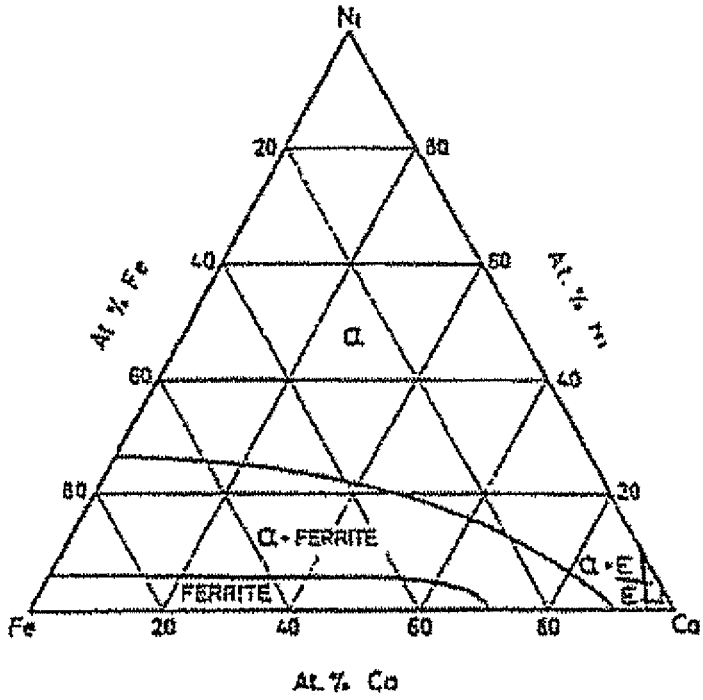
FIG. 3 illustrates the two boundary systems of the ternary system, FeCoNi.

When the binary phase diagrams FeNi (shown in FIG. 1) and FeCo (shown in FIG. 2), which represent two boundary systems of the ternary system, known at room temperature are examined, it is found that the published phase diagram FeCoNi (shown in FIG. 3, from Bradley, Bragg et al., J. Iron, Steel Inst. 1940, (142), pages 109-110) agrees on the Ni free side with that of FeCo (boundary line of two-phase region to the fcc region at about 10% Fe), but there are very large discrepancies on the Co-free side. While according to the three-component diagram, the boundary line between two-phase region/fcc in the boundary system FeNi is at about 26% of Ni, in the boundary system FeNi it is at 70% of Ni. If these two points on the boundary systems (FeNi 30/70 and FeCo 10/90) are now connected in the ternary system, the approximate course of the boundary line between two-phase region/fcc at room temperature can be drawn in as a line to show its approximate course in the ternary system.

Figure 4:
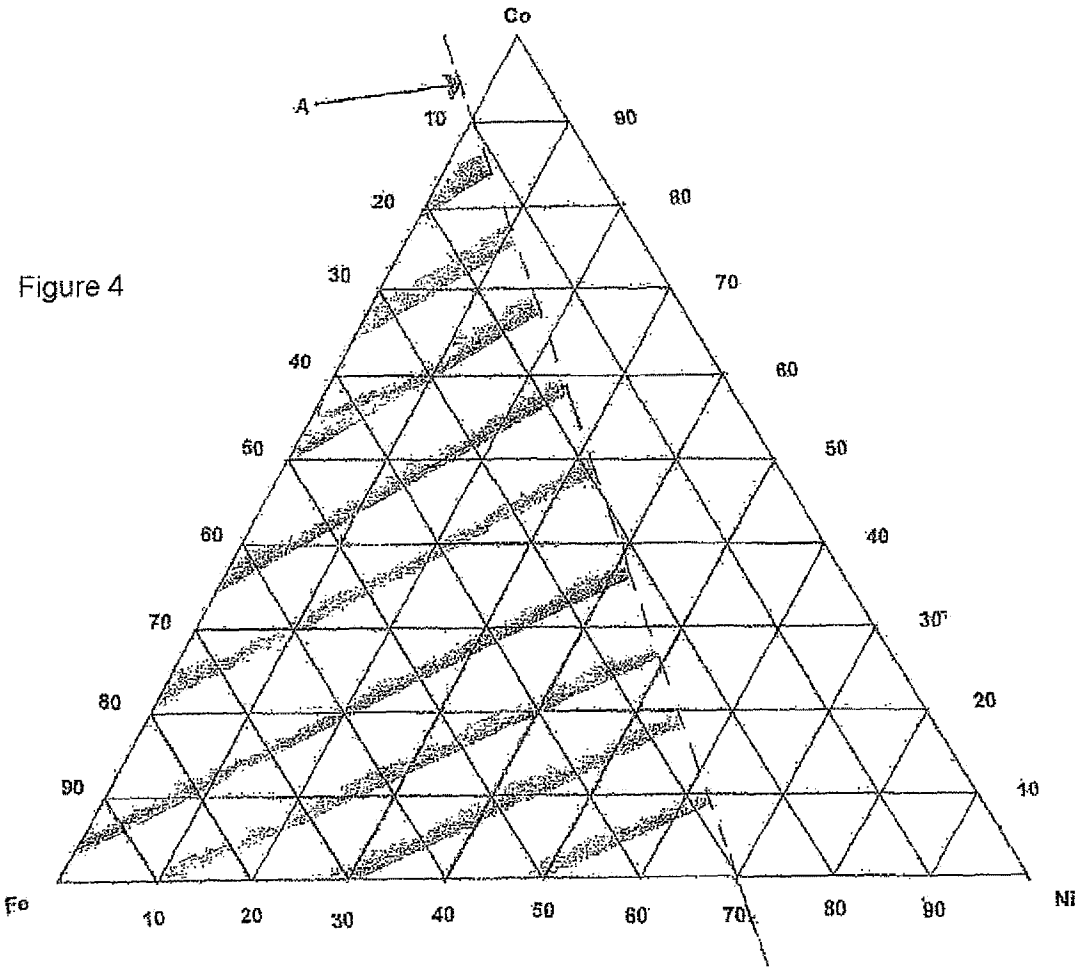
FIG. 4 illustrates the ternary system FeCoNi with the broken line A shows the boundary, and the hatched region to the left of the broken line A represents the region for the overall composition according to the invention.

This is shown in FIG. 4. In the diagram, the broken line A shows the boundary, and the hatched region to the left of the broken line A represents the region for the overall composition according to the invention. The line determined likewise represents an aid to selecting binder powders having a very high room-temperature-stable fcc content.

Interestingly, it can now be seen that, according to the boundary line obtained in this way, the composition FeCoNi 40/20/40 has to be present as two phases. The invention is therefore preferably performed at overall FeCoNi compositions of the binder which satisfy the conditions Co≦90% and Ni≦70%, with the additional condition $$Fe \geq 100\% - \frac{\%\ Co \cdot 90\%}{(\%\ Co + \%\ Ni)} - \frac{\%\ Ni \cdot 70\%}{(\%\ Co + \%\ Ni)}$$

This describes the boundary line A in FIG. 4 mathematically.

Iron powder is preferably used as element powder in component b), but an iron-rich alloyed powder can also be used. It can be deduced from the phase diagrams that this preferred region for the bcc powder stable at room temperature satisfies the conditions "Ni≦10%" and "Co≦70%". It is also possible to use any iron-rich, prealloyed powder having a higher proportion of room-temperature-stable bcc than the overall composition would have as prealloyed powder.

The overall composition of the binder calculated from the chemical compositions of the element or alloy powders used takes into account only the metal content of the powders used. The content of oxygen, nitrogen, carbon or any passivating agents which are organic in nature (for example waxes, polymers or antioxidants such as ascorbic acid) is not taken into account. This has to be taken into account particularly in the case of commercial carbonyl iron powders which can have carbon and nitrogen contents of in each case more than 1% by weight. Nevertheless, they are referred to as element powders. According to the invention, the elements copper, zinc or tin are preferably present in not more than traces, i.e. in amounts of in each case not more than 1000 ppm.

There is surprisingly no information in the literature as to how the shrinkage or the anisotropy thereof can be controlled in the case of FeCoNi-bonded cemented hard materials, although these are important parameters for controlling industrial production of articles which conform to, or are very close to, final dimensions.

Component a) is a prealloyed powder. The production of prealloyed powders is known in principle to those skilled in the art and is described, for example, in EP-A-1079950 and EP-A-865511, which are hereby incorporated by reference. These prealloyed powders can be produced by reduction of coprecipitated metal compounds or mixed oxides to the metal powder by means of hydrogen at temperatures in the range from 300° C. to 600° C. As an alternative, it is also possible to produce prealloyed metal powders by other methods in which it is possible for the metal components to become mixed by diffusion, for example mixing and heating of oxides. The reduction can also be achieved in other reducing gases at an appropriate temperature. Such processes are known to those skilled in the art or can be achieved by means of a small number of appropriate tests.

Powders which have been obtained by mixing and melting of element powders and subsequent atomization of the melt, wrongly referred to as prealloyed powders (e.g. atomized prealloy), are now also known in the literature. Such powders are expressly not encompassed by the term prealloyed powders as used here and differ greatly in their properties.

To produce prealloyed metal powders as are used according to the invention, an aqueous solution containing metal salts of the desired metals in the appropriate ratios to one another is mixed with an aqueous solution of, for example, a carboxylic acid, a hydroxide, carbonate or basic carbonate. The metal salts can advantageously be nitrates, sulfates or halides (in particular chlorides) of iron, cobalt or nickel. This results in formation of the insoluble compounds of the metals which precipitate from the solution and can be filtered off. The precipitation product is composed of hydroxides, carbonates or oxalates of the metals. This precipitation product can optionally be subjected to thermal decomposition at a temperature of from 200 to 1000° C. in an oxygen-containing atmosphere (calcination). The precipitation product can, after precipitation and drying or after a calcination step, be reduced to the prealloyed metal powder in a hydrogen atmosphere at a temperature of from 300° C. to 1000° C. Component a), viz. the prealloyed powder, comprises at least two metals selected from the group consisting of iron, nickel and cobalt. Examples of prealloyed powders in component a) are: prealloyed CoNi powder having any Co:Ni ratio in the range from 0 to 200, including powder prealloyed with up to 10% of Fe, FeNi powders containing up to 30% of Fe, FeNi 50/50. Examples of component b) are FeCo 50/50 FeCo 20/80, FeCoNi 90/5/5, FeNi 95/5.

Component b) is an element powder selected from the group consisting of iron, nickel and cobalt, or alternatively a further prealloyed powder. In one embodiment of the invention, component b) is a prealloyed powder selected from the group consisting of iron/nickel, iron/cobalt, iron/nickel/cobalt and nickel/cobalt which is different from component a).

The overall composition of the components a) and b) together preferably contains at least 10% by weight of iron and not more than 70% by weight of nickel. The proportion of room-temperature-stable fcc phase of the two components a) and b) is particularly preferably different and is higher than that of the components a) and b) if they were completely prealloyed with one another to give the desired overall composition of the binder. A content of not more than 90% of cobalt is also advantageous.

Components a) or b) can also in turn be made up of components having different compositions, so that the number of binder powders used is theoretically not limited. Here too, the choice of binder powders is carried out according to the invention, i.e. the proportion of room-temperature-stable fcc phase is greater than that of the overall composition as prealloyed powder.

In a further embodiment of the invention, the component b) according to the invention is a conventional iron powder or the component b) is a conventional nickel metal powder, for example for powder-metallurgical applications, or the component b) is a conventional cobalt powder. In this case, the component b) is advantageously a conventional iron or nickel powder.

These are powders which have an essentially spherical, irregular or fractal shape of the particles, as depicted, for example, in FIG. 1 of PCT/EP2004/00736. These metal powders are element powders, i.e. these powders consist essentially of one, advantageously pure, metal. The powder can contain normal impurities. These powders are known to those skilled in the art and are commercially available. Numerous metallurgical or chemical processes for producing them are known. If fine powders are to be produced, the known processes frequently start with melting of a metal. Mechanical coarse and fine comminution of metals or alloys is likewise frequently employed for producing "conventional powders", but leads to a nonspherical morphology of the powder particles. If it basically functions, it is a very simple and efficient method of powder production. (W. Schatt, K.-P. Wieters in "Powder Metallurgy—Processing and Materials", EPMA European Powder Metallurgy Association, 1997, 5-10). The morphology of the particles is also critically determined by the type of atomization.

Prealloyed powders are powders which comprise point-sintered primary particles and therefore have internal porosity and can therefore be comminuted in mix-milling, as described in WO 00/23631 A1, p. 1, lines 26-30. Metal powders atomized from the melt, on the other hand, are not suitable for the disclosed process since they do not have internal porosity. In the above-described mix-milling for producing the cemented hard material mixture, comminution does not occur when atomized metal powders are used but instead ductile deformation of the powder particles occurs, causing microstructural defects in the sintered cemented hard material. "Binder pools" which do not contain any hard material are known, as are elongated pores formed by deformed metal particles having a high aspect ratio melting during liquid-phase sintering and being soaked up by the surrounding hard material powder as a result of capillary forces to leave a pore which has the shape of the deformed metal particle. For these reasons, a point-sintered cobalt metal powder produced by hydrogen reduction of oxides or oxalates is preferably used in cemented hard material production. Although atomized cobalt metal powders are easier to produce, they have not been able to become established in the production of cemented hard material mixtures because of the above-described problems.

Apart from the production of conventional element powders for powder-metallurgical applications by atomization, use is frequently also made of other single-stage melt-metallurgical processes such as "melt spinning" i.e. casting of a melt onto a cooled roller to form a thin, generally easily broken up band, or "crucible melt extraction", i.e. dipping of a cooled, profiled fast-rotating roller into a metal melt to give particles or fibers.

A suitable variant for the production of conventional element powders for powder-metallurgical applications which are suitable for the production of the cemented hard material mixture according to the invention is the chemical route via reduction of metal oxides or metal salts (W. Schatt, K.-P. Wieters in "Powder Metallurgy—Processing and Materials", EPMA European Powder Metallurgy Association, 1997, 23-30), so that the procedure (apart from the use of the starting metal) is identical to the production of component a). Extremely fine particles having particle sizes below one micron can also be produced by a combination of vaporization and condensation processes of metals and via gas-phase reactions (W. Schatt, K.-P. Wieters in "Powder Metallurgy—Processing and Materials", EPMA European Powder Metallurgy Association, 1997, 39-41).

A known industrial process for producing iron, nickel and FeNi powders is the carbonyl process in which metal carbonyls are thermally decomposed. The particle sizes here are in the range from 0.3 to 10 μm, with powders having particle sizes of less than 5 μm often being suitable for cemented hard material production, for example the commercially available carbonyl iron powders of the CM type from BASF AG, Germany.

Component c), viz. the hard material powder, is known in principle to those skilled in the art and is commercially available. These hard material powders are powders of, for example, carbides, borides, nitrides, of metals of groups 4, 5 and 6 of the Periodic Table of the Elements. The hard material powders in the powder mixture according to the invention are particularly advantageously carbides, borides and nitrides of the elements of groups 4, 5 and 6 of the Periodic Table; in particular carbides, borides and nitrides of the elements molybdenum, tungsten, chromium, hafnium, vanadium, tantalum, niobium, zirconium. Advantageous hard materials are, in particular, titanium nitride, titanium boride, boron nitride, titanium carbide, chromium carbide or tungsten carbide. One or more of the compounds indicated above can be used as hard material powder.

In general, component c), viz. the hard material powder, is used in ratios of component a) and b): component c) of from 1:100 to 100:1 or from 1:10 to 10:1 or from 1:2 to 2:1 or of 1:1. If the hard material is tungsten carbide, boron nitride or titanium nitride, the ratio is advantageously from 3:1 to 1:100 or from 1:1 to 1:10 or from 1:2 to 1:7 or from 1:3 to 1:6.3.

In a further embodiment of the invention, the hard material is advantageously used in ratios of from 3:1 to 1:100 or from 1:1 to 1:10 or from 1:2 to 1:7 or from 1:3 to 1:6.3.

In a further embodiment of the invention, the cemented hard material mixture is a mixture of components a) and b) and component c) with the proviso that the ratio of component I to component III is from 3:1 to 1:100 or from 1:1 to 1:10 or from 1:2 to 1:7 or from 1:3 to 1:6.3. The average particle sizes before use in the process according to the invention are generally in the range from 0.1 μm to 100 μm.

As further components, the cemented hard material mixture according to the invention can contain customary organic and inorganic additives, e.g. organic film-forming binders, as described above.

The component a), viz. the prealloyed powder, and the component b), viz. the element powder or the further prealloyed powder, together make up the desired composition of the binder metal ("overall composition") for the component c), viz. the hard material. Here, the components a) and b) together contain at least 10% by weight of iron, the nickel content is not more than 70% by weight and the cobalt content is advantageously not more than 90% by weight. In addition, it is particularly advantageous for the iron content of the overall composition of the two components a) and b) together to satisfy the following inequality:

$$\mathrm{Fe} \geq 100\% \frac{\%\ \mathrm{Co} \cdot 90\%}{(\%\ \mathrm{Co} + \%\ \mathrm{Ni})} \frac{\%\ \mathrm{Ni} \cdot 70\%}{(\%\ \mathrm{Co} + \%\ \mathrm{Ni})}$$

(where Fe: iron content in % by weight, % Co: cobalt content in % by weight, % Ni: nickel content in % by weight).

The nickel content of components a) and b) together is advantageously 70% by weight or less.

In a further embodiment of the invention, the nickel content of the two components a) and b) together is 45% by weight or less of the powder mixture when the cobalt content is less than 5% by weight.

In a further embodiment of the invention, component a) is a prealloyed powder comprising iron and nickel and component b) is a conventional element powder composed of iron.

In a further embodiment of the invention, component a) is a prealloyed powder selected from the group consisting of FeNi 50/50 and FeCoNi 40/20/40 or a nickel metal powder. Here, the constituents of the prealloyed powder are indicated by the element abbreviations and the numbers indicate the amount of the corresponding metal in percent by weight. In this case, component b) is advantageously a conventional iron powder or a prealloyed powder of the composition FeCo 50/50, FeCoNi 90/5/5 or FeNi 90/10.

The cemented hard material mixture is, according to the invention, used for producing shaped articles by sintering. For this purpose, the cemented hard material mixture is pressed and sintered. The cemented hard material mixture according to the invention can be processed by known methods of powder-metallurgical processing to form green bodies and is subsequently sintered at a temperature of from 1220°

C. to 1600° C. for a time of from 0.1 hour to 20 hours with occurrence of a liquid metallic binder phase. If an organic additive is present, the green body has to be subjected to binder removal before sintering, which is achieved, for example, by heating to a temperature of from 200 to 450° C., but other methods are also possible.

Sintering advantageously takes place in an inert or reducing atmosphere or under reduced pressure. As inert gas, it is possible to use noble gases such as helium or argon, in some cases also nitrogen, and reducing gases which can be used are hydrogen or mixtures thereof with nitrogen, noble gases. Hydrocarbons are sometimes also employed.

The structuring of the total sintering cycle is of great importance for the mechanical properties of the cemented hard materials, but not for the shrinkage if densification during sintering is close to theoretical.

The invention is illustrated by the following examples. All examples describe a cemented hard material having the same nominal composition or overall composition of the binder. The sintered densities at a binder content of 20% were 13.1+/−0.1 g/cm$^3$, so that it was justifiable to employ this average value for calculating the global shrinkage, so that the examples can be compared more readily. Individual sintered pieces were metallographically prepared for monitoring, the porosity was better than A02 B02 in accordance with ISO 4505.

Comparative Example 1

As metallic binder powder, use was made of a prealloyed metal powder FeCoNi 70/10/20 Amperit® MAP HN from H. C. Starck GmbH, Germany having the following properties:

Iron 69.7% by weight, cobalt 10.3% by weight, nickel 19.5% by weight, oxygen 0.51% by weight, carbon 0.0242% by weight, FSSS 2.86 μm.

The powder was examined by X-ray diffraction analysis. The height ratio of the main fcc and bcc reflections was bcc/fcc=3.45. It could be estimated from this that the bcc content was about 78% by volume.

100 g of the binder metal powder were mix-milled with 400 g of WC (FSSS 0.6 (ASTM B330), grade WC DS 60, manufacturer: H. C. Starck GmbH) and 2.13 g of carbon black (specific surface area: 9.6 m$^2$/g) in 570 ml of alcohol and 30 ml of water in a ball mill (capacity: 21) using 5 kg of cemented hard material balls having a diameter of 15 mm at 63 rpm for 14 hours. The cemented hard material balls were separated off mechanically and the suspension obtained was heated with rotation in a glass flask at 65° C. and an absolute pressure of 175 mbar to separate off the milling liquid by distillation. This gave a cemented hard material powder which was sieved through a 400 μm sieve. The height ratio of the main bcc/fcc reflections was determined by X-ray diffraction analysis as 14.3, i.e. the proportion of bcc was about 94% by volume and the proportion of fcc was about 6% by volume. From this result, it can be assumed that the room-temperature-stable proportion of fcc phase for an FeCoNi 70/10/20 is not more than 6% by volume.

The cemented hard material powder was uniaxially pressed with a fixed lower punch at 100, 150 and 200 MPa, the densities of the pressed bodies were determined and the pressed bodies were sintered at 1400° C. under reduced pressure for 1 hour. The following table shows the results obtained in this way:

| Pressing pressure (MPa) | 100 | 150 | 200 |
|---|---|---|---|
| Pressed density (g/cm$^3$) | 6.01 | 6.25 | 6.45 |
| Global shrinkage (calculated from pressed density and sintered density, in %) | 22.87 | 21.86 | 21.04 |

The change in the phase composition is presumably due to the completely prealloyed binder powder being supersaturated in respect of the content of face-centered cubic phase at room temperature and an acceleration of the transformation rate from fcc to bcc occurring as a result of mechanical activation during mix-milling.

Comparative Example 2

Example 1) was repeated using the following element metal powders instead of the prealloyed binder powder:

| Amount | Element | Manufacturer | FSSS* | Phase composition according to X-ray diffraction analysis |
|---|---|---|---|---|
| 70 g | Iron | BASF, D | 2.47 | Pure bcc |
| 10 g | Cobalt | Umicore, B | 0.9 | Hexagonal:fcc 1:25 |
| 20 g | Nickel | Inco Specialities, GB | 2.8 | Pure fcc |

*ASTM B330

Owing to the carbon content of the element powders, the amount of carbon black added had to be reduced to 0.84 g in order to achieve the same carbon content of the formulation as in example 1. Since only the Ni powder is stable fcc at room temperature and the Co powder is predominantly hexagonal, the proportion by weight of the fcc phase in the binder powders used is 20.67%; in contrast, the proportion of fcc stable at room temperature is 20% since the fcc fraction in the cobalt metal powder is metastable at room temperature while iron is bcc at room temperature and cobalt is stable hexagonal.

The following results were obtained:

| Pressing pressure (MPa) | 100 | 150 | 200 |
|---|---|---|---|
| Pressed density (g/cm$^3$) | 6.28 | 6.47 | 6.59 |
| Global shrinkage (calculated from pressed density and sintered density, in %) | 21.74 | 20.95 | 20.47 |

Comparative Example 3 a) Example 1) was repeated but 0.71 g of graphite powder having a BET surface area of 20 m$^2$/g a d50 of 3.3 μm and d90 of 6.5 μm was added as internal lubricant and the amount of carbon black added was reduced by the same amount. The results obtained are shown in the following table:

| Pressing pressure (MPa) | 100 | 150 | 200 |
|---|---|---|---|
| Pressed density (g/cm$^3$) | 6.27 | 6.49 | 6.68 |
| Global shrinkage (calculated from pressed density and sintered density, in %) | 21.78 | 20.87 | 20.11 |

Comparison of examples 1 and 2 shows that the green density obtained using completely prealloyed binder powders is comparable to that obtained using the individual powders.

b) The procedure in comparative example 3b below was identical to that in 3 a but a graphite powder having a BET surface area of 14.2 $m^2/g$, a d50 of 6 μm and a d90 of 12 μm was used:

| Pressing pressure (MPa) | 100 | 150 | 200 |
|---|---|---|---|
| Pressed density ($g/cm^3$) | 6.52 | 6.8 | 6.94 |
| Global shrinkage (calculated from pressed density and sintered density, in %) | 20.83 | 19.72 | 19.17 |

Example 4

Example 1 was repeated but the following amounts of prealloyed binder powder or Fe metal powder were added instead of the prealloyed binder powder:

| Amount | Manufacturer | FSSS* | Phase composition according to X-ray diffraction analysis |
|---|---|---|---|
| 40 g of FeNi 50/50 | H. C. Starck | 2.01 | Pure fcc |
| 20 g of FeCo 50/50 | H. C. Starck | 1.26 | Pure bcc |
| 40 g of Fe powder | BASF | 2.47 | Pure bcc |

*ASTM B330

The amount of carbon black added was 1.94 g in order to set the same carbon content of the formulation as in example 1. The fcc content to be assumed at room temperature should be about and is calculated as follows: according to the FeNi phase diagram, an FeNi 50/50 is unstable at room temperature and demixes to form FeNi 90/10 and FeNi 30/70. The proportions of the two demixing products are ⅓ for the FeNi 90/10 and ⅔ for the FeNi 30/70. This means that the FeNi 50/50 has a proportion of room-temperature-stable fcc phase of ⅔. FeCo 50/50 and Fe are room-temperature-stable bcc. The proportion of the room-temperature-stable fcc phase based on the overall composition is therefore ⅔×40%=26.7%.

The results are summarized in the following table:

| Pressing pressure (MPa) | 100 | 150 | 200 |
|---|---|---|---|
| Pressed density ($g/cm^3$) | 7.19 | 7.33 | 7.44 |
| Global shrinkage (calculated from pressed density and sintered density, in %) | 18.12 | 17.6 | 17.19 |

Example 5

Example 1 was repeated but the following amounts of prealloyed binder powder or Fe powder were added instead of the prealloyed binder powder:

| Amount | Manufacturer | FSSS* | Phase composition according to X-ray diffraction analysis |
|---|---|---|---|
| 50 g of FeCoNi 40/20/40 | H. C. Starck | 0.96 | Bcc/fcc = 0.77, fcc = 56.5% by weight |
| 50 g of Fe powder | BASF | 2.47 | Pure bcc |

*ASTM B330

The amount of carbon black added was 2.03 g in order to set the same carbon content of the formulation as in example 1. The total proportion of fcc phase is 0.5×56.3%=28.3%. The proportion of the fcc phase which can be assumed to be stable at room temperature in the prealloyed binder fraction after mix-milling is difficult to estimate since the FeCoNi phase diagram for this alloyed composition at room temperature is not known, but should be significantly below 50% since the FeCoNi 40/20/40 starting powder precipitates bcc phase below about 500° C. Thus, the proportion of fcc in the binder which is stable at room temperature would have been less than 25%.

The results obtained are summarized in the following table:

| Pressing pressure (MPa) | 100 | 150 | 200 |
|---|---|---|---|
| Pressed density ($g/cm^3$) | 6.76 | 6.93 | 7.06 |
| Global shrinkage (calculated from pressed density and sintered density, in %) | 19.79 | 19.12 | 18.62 |

The results of examples 1 to 5 are shown in FIG. 1. It can be seen that the green density is highest and the global shrinkage is lowest when all metal powders used are stable as a single phase and the proportion of fcc stable at room temperature is very high.

Comparative Example 6

Example 2 was repeated. Part of the cemented hard material powder was pressed directly after drying, and a further part was infiltrated as described in WO 2004 014586 with 2 parts by weight of paraffin per 98 parts by weight of cemented hard material powder in order to achieve a homogeneous wax distribution. The results for "waxed" and "unwaxed" are compared in the following table. In the case of the values for the "waxed" pressed density, the measured value for the pressed density was multiplied by the factor 0.98 since the wax is driven off during sintering.

It can be deduced from the results that the use of pressing aids is neutral in respect of the pressed density and the global shrinkage determined thereby, but that the differences in the observed shrinkage measured perpendicular and parallel to the pressing direction are reduced from about 1 percentage point in the unwaxed case to 0.6-0.8 percentage points in the waxed case. The undesirable anisotropy of the shrinkage can thus only be moderated by means of a pressing aid. The disadvantages of the use of element powders during sintering remain.

| Pressing pressure (MPa) | 100 | 150 | 200 |
|---|---|---|---|
| Pressed density g/cm$^3$ | | | |
| waxed | 6.47 | 6.64 | 6.76 |
| unwaxed | 6.48 | 6.63 | 6.74 |
| Global shrinkage (calculated from pressed density and sintered density, %) | | | |
| waxed | 20.95 | 20.27 | 19.79 |
| unwaxed | 20.92 | 20.31 | 19.87 |
| Measured shrinkages (%) Perpendicular to the pressing direction | | | |
| waxed | 20.29 | 19.77 | 19.15 |
| unwaxed | 20.56 | 20.04 | 19.64 |
| Parallel to the pressing direction | | | |
| waxed | 20.88 | 20.39 | 19.95 |
| unwaxed | 21.50 | 21.10 | 20.59 |
| K value | | | |
| waxed | 0.995 | 0.995 | 0.993 |
| unwaxed | 0.992 | 0.994 | 0.992 |

Comparative Example 7

The cemented hard material powder from example 1 was infiltrated with paraffin wax so that a content of 2% was obtained. The pressed densities, corrected for the wax content, were 5.99 (100 MPa), 6.39 (150 MPa) and 6.61 (200 MPa). Comparison with example 1 shows that there is only a slight improvement in the green density as a result of the addition of wax.

It can be concluded from examples 6 and 7 that the global densification behavior on pressing is dominated by the phase state of the binder metal powder after mix-milling and only to a secondary degree by the addition of lubricant.

Example 8 a) According to the Invention 3 cemented hard material mixtures containing 6% by weight of an FeCoNi 70/10/20 binder were produced, pressed and sintered in a manner analogous to the preceding examples. The sintering temperature was 1500° C. The formulation of the binder was varied:

a) consisting of FeCo 50/50, FeNi 50/50 and Fe powders in a weight ratio of 1:2:2 b) consisting of completely prealloyed FeCoNi 70/10/20 c) consisting of the element powders

The sintered density was 14.80 g/cm$^3$+/0.03, but variant b) displayed porosity and therefore achieved only 14.54 g/cm$^3$.

The differences in green density and shrinkage in the three variants containing 6% of hinder are not as pronounced as at 20% since the proportion of binder is naturally less strongly weighted in the pressing forces.

Compared to variant c), variant a) displays lower anisotropy of the shrinkage.

Variant b) could not be sintered to high density, which is an indication of poor homogeneity of the green density and evidence of very high internal friction during pressing. The shrinkage values can therefore not be assessed.

The results are summarized in the following table (in each case a to c beneath one another):

| Pressed density (MPa) | 100 | 150 | 200 |
|---|---|---|---|
| Green density g/cm$^3$ | | | |
| a) | 7.50 | 7.63 | 7.79 |
| b) | 7.35 | 7.63 | 7.79 |
| c) | 7.31 | 7.51 | 7.66 |
| Global shrinkage (calculated from pressed density and sintered density, %) | | | |
| a) | 20.27 | 19.82 | 19.26 |
| b) | 20.81 | 20.13 | 19.64 |
| c) | 20.95 | 20.24 | 19.71 |
| Measured shrinkages (%) Perpendicular to the pressing direction | | | |
| a) | 20.59 | 19.82 | 19.26 |
| b) | 20.20* | 20.13* | 19.64* |
| c) | 20.53 | 20.24 | 19.71 |
| Parallel to the pressing direction | | | |
| a) | 20.36 | 19.79 | 19.42 |
| b) | 20.45* | 19.93* | 19.57* |
| c) | 21.25 | 20.52 | 19.97 |
| K value | | | |
| a) | 1.002 | 1.000 | 0.999 |
| b) | 0.998* | 1.002* | 1.001* |
| c) | 0.994 | 0.998 | 0.998 |

*Not able to be evaluated because of the porosity

Examples 9 to 12

Partly According to the Invention

The cemented hard material powders from comparative examples 1 and 2 and examples 4 and 5 (comparative examples 9 and 10, examples 11 and 12) were again pressed, the pressed bodies were measured and sintered at 1410° C. under reduced pressure. The sintered bodies were measured by determining the dimensions parallel and perpendicular to the pressing direction and the shrinkages in the two directions were subsequently measured with the aid of the dimensions in the pressed state.

| | Pressing pressure: | | |
|---|---|---|---|
| Cemented hard material powder: | 100 MPa | 150 MPa | 200 MPa |
| From example 1 (not according to the invention) | | | |
| Shrinkage perpendicular (%) | 19.64 | 18.76 | 17.94 |
| Shrinkage parallel (%) | 27.23 | 26.24 | 24.93 |
| K value | 0.940 | 0.941 | 0.944 |
| From example 2 (not according to the invention) | | | |
| Shrinkage perpendicular (%) | 20.56 | 20.04 | 19.64 |
| Shrinkage parallel (%) | 21.5 | 21.1 | 20.59 |
| K value | 0.992 | 0.991 | 0.992 |
| From example 4 (according to the invention) | | | |
| Shrinkage perpendicular (%) | 18.3 | 17.9 | 17.31 |
| Shrinkage parallel (%) | 19.1 | 18.6 | 18.32 |

-continued

| Cemented hard material powder: | Pressing pressure: 100 MPa | 150 MPa | 200 MPa |
|---|---|---|---|
| K value | 0.993 | 0.994 | 0.992 |
| From example 5 (according to the invention) | | | |
| Shrinkage perpendicular (%) | 20 | 19.21 | 18.8 |
| Shrinkage parallel (%) | 20.23 | 19.81 | 19.46 |
| K value | 0.998 | 0.995 | 0.994 |

The results of examples 9 to 12 particularly clearly illustrate the subject matter of the invention. The two embodiments according to the invention display a significantly lower shrinkage combined with a higher K value compared to the use of element powders. The completely prealloyed powder gives a very much smaller K value at high shrinkages, and this is even below the K value for cemented hard materials containing 20% of cobalt. The K values obtained according to the invention and with element powders are above the value of 0.988 reported in EP 0 937 781 B1 and it can therefore be assumed that these three cemented hard material mixtures are suitable for the production of sintered cemented hard material parts without after-machining. the two embodiments according to the invention additionally offer the advantage over the use of pure element powders of an overall lower shrinkage, which additionally assists the production of sintered bodies having the required final dimensions and demonstrates the advantages of prealloyed powders in sintering.

Summarizing the results of the examples, it is firstly clear that, surprisingly, although the paraffin wax usually used as lubricant in the cemented hard materials industry improves the green density and the shrinkage it does not increase the K value. This can be explained by the lubricant assisting the rotation or movement of particles against one another which occurs during pressing but naturally not assisting the deformation of metallic binder particles which is likewise necessary.

The examples also show that the alloying state of the binder is the main factor influencing the shrinkage and the K value. This applies increasingly as the binder content increases. At a binder content of 6%, the influence is significantly lower, which confirms the presumption that the role of the binder is decisive. The deformability of the binder particles would thus be decisive.

Figure 5:
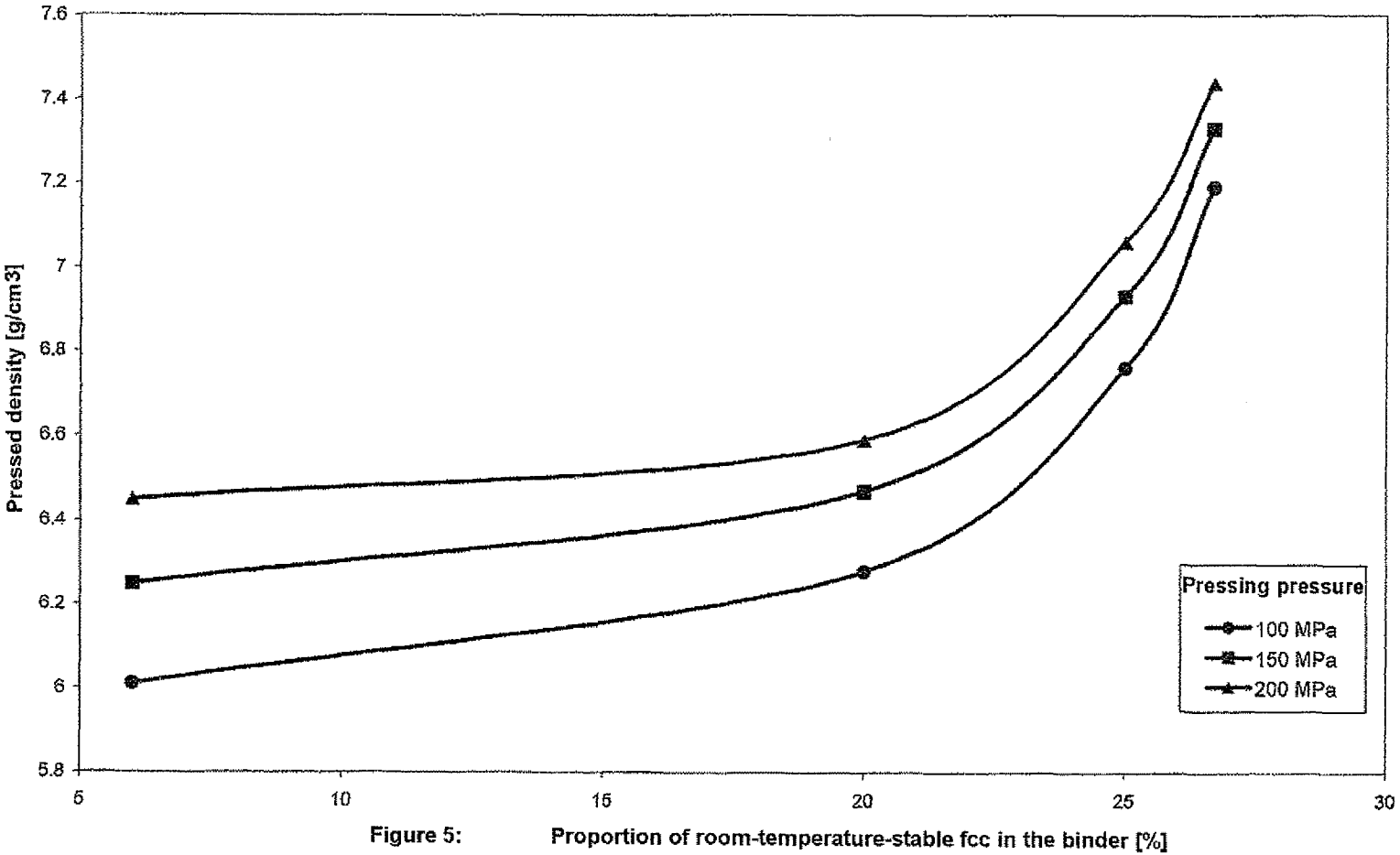
FIG. 5 illustrates the density increases disproportionately with the proportion of room-temperature-stable fee phase.

It is also clear that the phase transformations or precipitates, presumably caused by mechanical activation of precipitation processes or phase transformations of prealloyed powders during mix-milling with tungsten carbide, lead to increased difficulty in achieving densification during pressing by impairing the deformability. Since the proportion of body-centered cubic phase increases, it can be assumed that mechanically activated precipitation hardening occurs. In addition, it is known that body-centered cubic metal alloys are less deformable than phase-centered cubic alloys since they have fewer crystallographic glide planes. The green density increases disproportionately with the proportion of room-temperature-stable fcc phase. This is shown in FIG. 5.

Example 13

Using a method analogous to the above examples, three different binder metal powders having the same overall composition (Fe 85% by weight, Ni 15% by weight) were used together with a tungsten carbide powder (WC) having an FSSS value of 0.6 μm for producing three cemented hard material powders each containing 90% by weight of tungsten carbide without further organic or inorganic additives:

a) using pure iron and nickel powders (not according to the invention, proportion of room-temperature-stable fcc phase=15% since only nickel is stable fcc at room temperature)

b) using a completely prealloyed alloy powder (not according to the invention) comprising virtually completely bcc phase c) using prealloyed FeNi 50/50 and iron powder (according to the invention). The proportion of room-temperature-stable phase is here estimated as follows: according to the lever principle, it can be estimated for FeNi 50/50 from FIG. 4 that the ratio of room-temperature-stable fcc phase to bcc phase has to be 2.5:1, which gives a proportion of 71.4%. Since, on the other hand, 30% of FeNi 50/50 powder is present in the binder metal formulation, the proportion of room-temperature-stable fcc phase is 0.3×71.4% 21.4%.

The further procedure was as in the above examples, but sintering was carried out at 1420° C. under reduced pressure for 45 minutes. The cemented hard material powders obtained were used without addition of wax.

FIG. 7 shows the results obtained for the dependence of the shrinkage on pressing pressure, on the alloying state of the binder metal powders and in directions perpendicular and parallel to the pressing direction. When element powders are used, virtually complete isotropy is obtained: the lines virtually coincide. In the case of the completely prealloyed binder metal powder, the expected very high anisotropy of the shrinkage is observed and a very much higher shrinkage is found in the direction parallel to the pressing direction. In case c) according to the invention ("FeNi 50/50+Fe"), there is a very significant reduction in the shrinkage compared to a), with an anisotropy acceptable for industrial production (K value of 0.9937 at 150 MPa).

The invention claimed is:

1. A process for producing a cemented hard material mixture which comprises mixing a) at least one prealloyed powder selected from the group consisting of iron/nickel, iron/cobalt, iron/nickel/cobalt and nickel/cobalt;

b) at least one element powder selected from the group consisting of iron, nickel and cobalt or a prealloyed powder selected from the group consisting of iron/nickel, iron/cobalt, iron/nickel/cobalt and nickel/cobalt which is different from component a);

c) hard material powder, wherein the overall composition of the components a) and b) together contains not more than 90% by weight of cobalt and not more than 70% by weight of nickel and the iron content satisfies the inequality $$\mathrm{Fe} \geq 100\% - \frac{\%\ \mathrm{Co} \cdot 90\%}{(\%\ \mathrm{Co} + \%\ \mathrm{Ni})} - \frac{\%\ \mathrm{Ni} \cdot 70\%}{(\%\ \mathrm{Co} + \%\ \mathrm{Ni})}.$$

2. The process as claimed in claim 1, wherein the overall composition of the binder comprises at least 10% by weight of Fe, wherein the iron content satisfies the inequality $$\mathrm{Fe} \geq 100\% - \frac{\%\ \mathrm{Co} \cdot 90\%}{(\%\ \mathrm{Co} + \%\ \mathrm{Ni})} - \frac{\%\ \mathrm{Ni} \cdot 70\%}{(\%\ \mathrm{Co} + \%\ \mathrm{Ni})}$$

and at least two binder powders a) and b) are used, one binder powder is lower in iron than the overall composition of the binder and the other binder powder is richer in iron than the overall composition of the binder and at least one binder powder is prealloyed from at least two elements selected from the group consisting of iron, nickel and cobalt.

3. The process as claimed in claim 1, wherein the nickel content of the components together makes up 60% or less of the powder mixture.

4. The process as claimed in claim 1, wherein the iron content of the two components together makes up 5% or more of the powder mixture.

5. The process as claimed in claim 1, wherein the nickel content of the two components together makes up 45% by weight or less of the powder mixture when the cobalt content is less than 5% by weight.

6. The process as claimed in claim 1, wherein component a) is a prealloyed metal powder and component b) is an element powder and the contents of iron, nickel and cobalt add up to the desired total composition of the binder powder.

7. The process as claimed in claim 1, wherein a) is a prealloyed powder comprising iron/nickel and b) is an iron powder.

8. The process as claimed in claim 1, wherein component a) is a prealloyed powder FeNi 50/50, FeCo 50/50 or FeCoNi 40/20/40.

9. The process as claimed in claim 1, wherein the majority of the mixture contains iron and nickel.

10. The process as claimed in claim 9, wherein the majority of the mixture further contains cobalt.

11. A metallic powder mixture comprising a) at least one prealloyed powder selected from the group consisting of iron/nickel, iron/cobalt, iron/nickel/cobalt and nickel/cobalt; b) at least one element powder selected from the group consisting of iron, nickel and cobalt or a prealloyed powder selected from the group consisting of iron/nickel, iron/cobalt, iron/nickel/cobalt and nickel/cobalt which is different from component a).

12. The metallic powder mixture as claimed in claim 11, wherein the overall composition of the components a) and b) together contains not more than 90% by weight of cobalt and not more than 70% by weight of nickel and the iron content satisfies the inequality $$\mathrm{Fe} \geq 100\% - \frac{\%\ \mathrm{Co} \cdot 90\%}{(\%\ \mathrm{Co} + \%\ \mathrm{Ni})} - \frac{\%\ \mathrm{Ni} \cdot 70\%}{(\%\ \mathrm{Co} + \%\ \mathrm{Ni})}.$$

13. The metallic powder mixture as claimed in claim 11, which further contains organic and/or inorganic additives.

14. The metallic powder mixture as claimed in claim 11, which further contains a component c) which is a hard material.

15. A binder mixture which comprises the metallic powder mixture as claimed in claim 11.

16. The metallic powder mixture as claimed in claim 11, wherein the majority of the mixture contains iron and nickel.

17. The metallic powder as claimed in claim 16, wherein the majority of the mixture further contains cobalt.

18. The metallic powder mixture as claimed in claim 11, wherein said at least one element powder b) is selected from the group consisting of iron and nickel or a prealloyed powder selected from the group consisting of iron/nickel, iron/cobalt, iron/nickel/cobalt and nickel/cobalt which is different from component a).

19. The metallic powder mixture as claimed in claim 11, wherein said at least one element powder b) is selected from the group consisting of iron and nickel.

20. A process for producing shaped articles which comprises the following steps:

providing a first prealloyed metal powder (component a), providing an element powder or a second prealloyed metal powder (component b), mix-milling of the two components a and b using a milling liquid to give a mixture of the milling liquid and a cemented hard material and removing the milling liquid to give a cemented hard material mixture, pressing and sintering of the cemented hard material mixture, giving a shaped article composed of a cemented hard material and wherein component a) is at least one prealloyed powder selected from the group consisting of iron/nickel, iron/cobalt, iron/nickel/cobalt and nickel/cobalt; and component b) is at least one element powder selected from the group consisting of iron, nickel and cobalt or a prealloyed powder selected from the group consisting of iron/nickel, iron/cobalt, iron/nickel/cobalt and nickel/cobalt which is different from component a).

21. The process as claimed in claim 20, wherein the process further comprises mixing component c) with components a and b, wherein component c) is a hard material powder, wherein the overall composition of the components a) and b) together contains not more than 90% by weight of cobalt and not more than 70% by weight of nickel and the iron content satisfies the inequality $$\mathrm{Fe} \geq 100\% - \frac{\%\ \mathrm{Co} \cdot 90\%}{(\%\ \mathrm{Co} + \%\ \mathrm{Ni})} - \frac{\%\ \mathrm{Ni} \cdot 70\%}{(\%\ \mathrm{Co} + \%\ \mathrm{Ni})}.$$

* * * * *